United States Patent [19]

Negley

[11] Patent Number: 4,841,653

[45] Date of Patent: Jun. 27, 1989

[54] IDENTIFICATION OF WORK PIECES

[76] Inventor: Mike Negley, 2217 Woodereek Dr., East, Safety Harbor, Fla. 34695

[21] Appl. No.: 124,002

[22] Filed: Nov. 23, 1987

[51] Int. Cl.[4] ..... G09F 3/02

[52] U.S. Cl. ..... 40/625; 40/913; 116/210

[58] Field of Search ..... 7/138; 33/168 R; 40/913, 915, 625, 630; 81/119, 124.4, DIG. 5; 116/335, DIG. 41, 201

[56] References Cited

U.S. PATENT DOCUMENTS

| | | | |
|---|---|---|---|
| 1,816,642 | 7/1931 | Fetter | 116/DIG. 41 |
| 1,984,839 | 12/1934 | Murray | 40/913 |
| 2,161,163 | 6/1939 | Hedgpeth | 40/913 |
| 3,251,150 | 5/1966 | Sedgwick et al. | 40/625 |
| 3,747,603 | 7/1973 | Adler | 128/341 |
| 4,202,351 | 5/1980 | Biche | 128/696 |
| 4,282,783 | 8/1981 | Fortune | 81/427.5 |
| 4,321,040 | 3/1982 | Miller et al. | 433/102 |
| 4,671,916 | 6/1987 | Hamas | 264/249 |

*Primary Examiner*—William A. Cuchlinski, Jr.
*Assistant Examiner*—W. Morris Worth

[57] ABSTRACT

Identification of work pieces such as wrenches by providing a unique color marking that permits a desired wrench to be selected from a group of wrenches by identifying the unique marking. The marking can be a color code provided by a single band of colored tape affixed to the work piece and unique for each different size of the work piece. In another color coding scheme a different color is assigned to each different digit of the numerical system. Two color bands can then represent a two digit numerator of a functional size and two additional color bands can represent the denominator so that any size from 0 to 98/99 can be indicated.

6 Claims, 3 Drawing Sheets

IDENTIFICATION OF WORK PIECES

THE BACKGROUND OF THE INVENTION

This invention relates to the selective identification of work pieces and more particularly to the marking of work pieces to facilitate their identification during use.

Many work pieces, such as wrenches, are available in a wide variety of sizes. In the case of so called "end" wrenches, it is common practice to have a complete assemblage with successive graduations. For example, in the case of open-end and box-end wrenches with metric openings, the successive wrenches can cover the gamut from 5–25 millimeters. An opening of 5 millimeters is difficult to distinguish from an openings of 6 millimeters. A similar consideration applies to tools and wrenches which bear English gradations. Thus, a wrench with a 9/16th opening is difficult to distinguish from the next larger or smaller size which may be ½ or ⅝.

In order to distinguish among the various sizes is it common practice to mark the wrenches by stamping, which desirably produces an impression in the tool. This procedure is satisfactory when size markings are readily visible. In many situations, however, for example, where a mechanic is working on an automobile, he may want to reach for the tool without having to focus on the size marking.

Accordingly, it is an object of the invention to facilitate the identification by size of similar sized work pieces and tools. A related object is to facilitate the individual identifications of socket, box end and open end wrenches which have approximately the same size openings.

Another object of the invention is to permit a user to quickly select a tool of the desired size without having to view either the opening of the tool or the size stamped on the tool.

SUMMARY OF THE INVENTION

In accomplishing the foregoing and related objects the invention produces readily differentiable work pieces with a distinctively different non-alphanumeric marking on each work piece.

The marking advantageously is a color code with a different code for each different work piece. As a result, the size differences among the various work pieces are readily apparent from the different distinctive color identifications. The work pieces can form a set of wrenches with distinctive color identifications that can be provided by colored tape applied to each work piece.

In accordance with one aspect of the invention the color identifications are formed by color bands which are provided in accordance with a prescribed code. A suitable color code has the following numerical correlations:

| | | |
|---|---|---|
| 3/16" Yellow | 7/16" Brown | 11/16" Red |
| ¼" Tan | ½" Green | ¾" Lt. Blue |
| 5/16" Gray | 9/16" Orange | 13/16" Magenta |
| ⅜" Blue | ⅝" Black | ⅞" Lt. Green |
| 15/16" Purple | | 1" Gold |

Another alternative is as follows: black=0, brown=1, red=2, orange=3, yellow=4, green=5, blue=6, violet=7, gray=8, white=9.

In accordance with another aspect of the invention metric measure is indicated by a solid color band; while English measure can be indicated by a striped color. The work pieces can be wrenches with metric openings given by two color bands permitting a range of markings from 5 millimeters to 25 millimeters. Where the wrenches have English measure openings, color bands can be used permitting a range of markings from 3/16 inches to 1 inch. It will be appreciated that other metric and English sizes can be accommodated and that the indicated sizes are merely illustrative.

In a method of distinguishing among variously sized work pieces, the steps include (A) viewing a group of pieces that each have a different and unique non-alphanumeric marking; and (B) selecting from the group a desired work piece having a distinctive non-alphanumeric marking associated with that work piece.

When the work pieces are wrenches, each has a unique color marking that permits a desired wrench to be selected from among a group by identifying the marking that is unique to the desired wrench. The unique non-alphanumeric marking can be a color code provided by a colored tape affixed to each work piece, such as a wrench.

In a method of providing for distinction among variously sized work pieces the steps include assigning a different and unique non-alphanumeric marking to each work piece; and applying a different and unique non-alphanumeric marking to each work piece. The unique non-alphanumeric marking can be a color code provided by colored tape affixed to each work piece, such as a wrench.

DESCRIPTION OF THE DRAWINGS

Other aspects of the invention will become apparent after considering several illustrative embodiments, taken in conjunction with the drawings in which.

DETAILED DESCRIPTION

Figure 1:
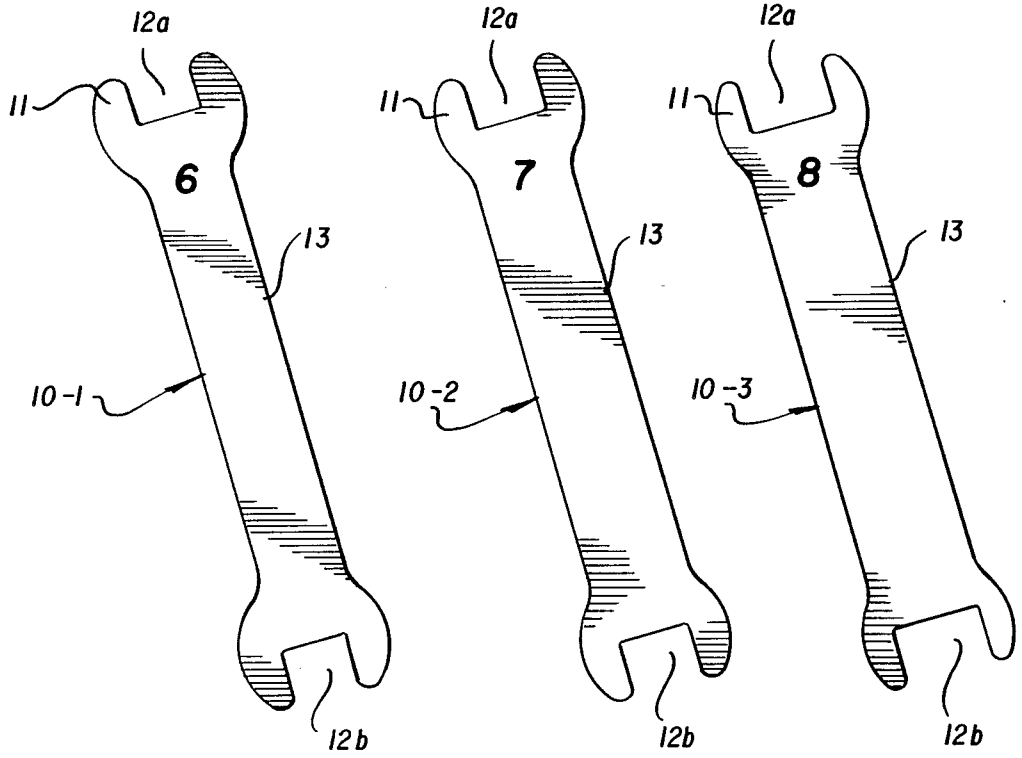
FIG. 1 is a set of metric open-end wrenches in accordance with the prior art.

With reference to the drawings, FIG. 1 shows a set of illustrative work pieces, namely open-end wrenches 10-1, 10-2 and 10-3 which have head portions 11 containing jaws **12*a* and 12*b* which are separated in accordance with the particular size associated with the individual wrench. In the case of FIG. 1 the illustrative sizes are 6, 7 and 8 millimeters. A numeric marking indicating the wrench size is typically stamped on the shank 13 of each wrench or upon the head 11. In the case of FIG. 1 where only 3 wrenches of the set are shown for illustration, the sizes are stamped on the shank portions 13. The first wrench 10-1 has a 6 millimeter head opening while the second and third wrenchs 10-2 and 10-3** have respective 7 and 8 millimeter openings.

It will be appreciated that the difference in opening among the wrenches is difficult to perceive visually since the difference between 10-1 and 10-2 and also the difference between 10-2 and 10-3 is only 1 millimeter which is on the order of less than 0.004 of an inch. This difference in size is difficult to perceive casually and results in frequent trial and error attempts to find the correct size wrench in practice.

Figure 2:
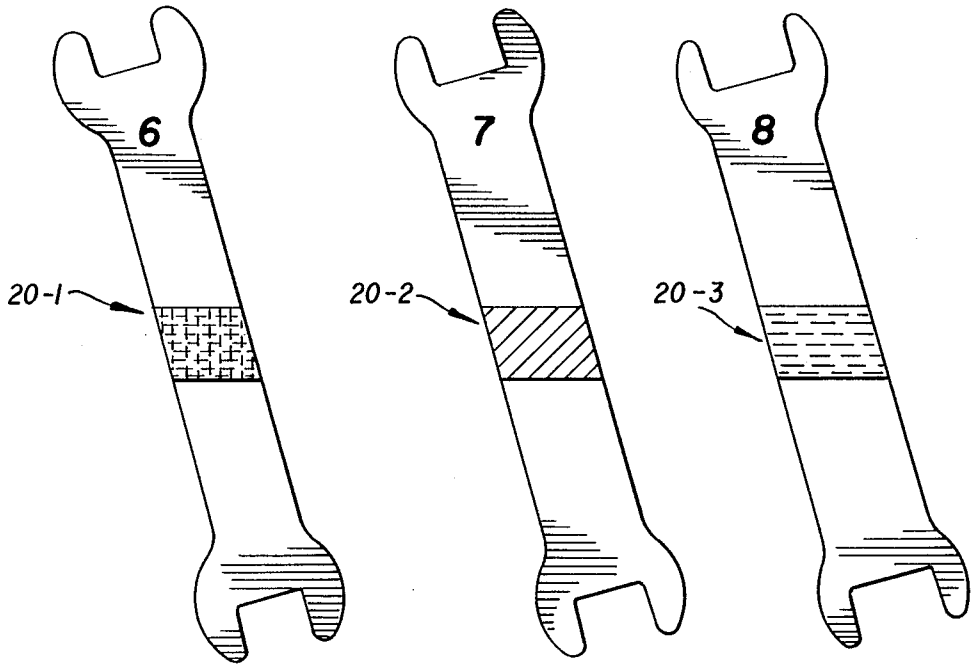
FIG. 2 is a modification of the prior art wrenches in accordance with the invention providing a non alphanumeric set of markings to facilitate selection of a desired wrench from among a set of similar wrenches.

The invention overcomes the sizing difficulty for similarly dimensioned work pieces as illustrated by the modification of Fig.1 shown in FIG. 2.

The wrenches of FIG. 2 have applied on their shanks color bands which indicate the respective sizes. Thus, the wrench 20-1 which has a 6 millimeter jaw opening has a blue band, representing "06", for a 6 millimeter opening. Similarly, the wrench 20-2 has a violet band for a 7 millimeter opening. Finally the wrench 20-3 has a gray band representing and 8 millimeter opening.

It will be appreciated that other coding schemes may be employed in accordance with the invention. For example, the body of the wrench may be of a solid color to indicate one digit of the size code, with a band to indicate a further digit of the size code. In another coding scheme each different digit of the jaw or other opening may have a separate color band so that a 6 millimeter jaw can be represented by two bands that are black and blue that are for "0" and "6". Using this same scheme the bands for a 10 millimeter jaw could be brown and black. In addition, although colored tape is contemplated for the embodiment of Fig. 2 other forms of coloration, such as by painting, may be employed.

Figure 3:
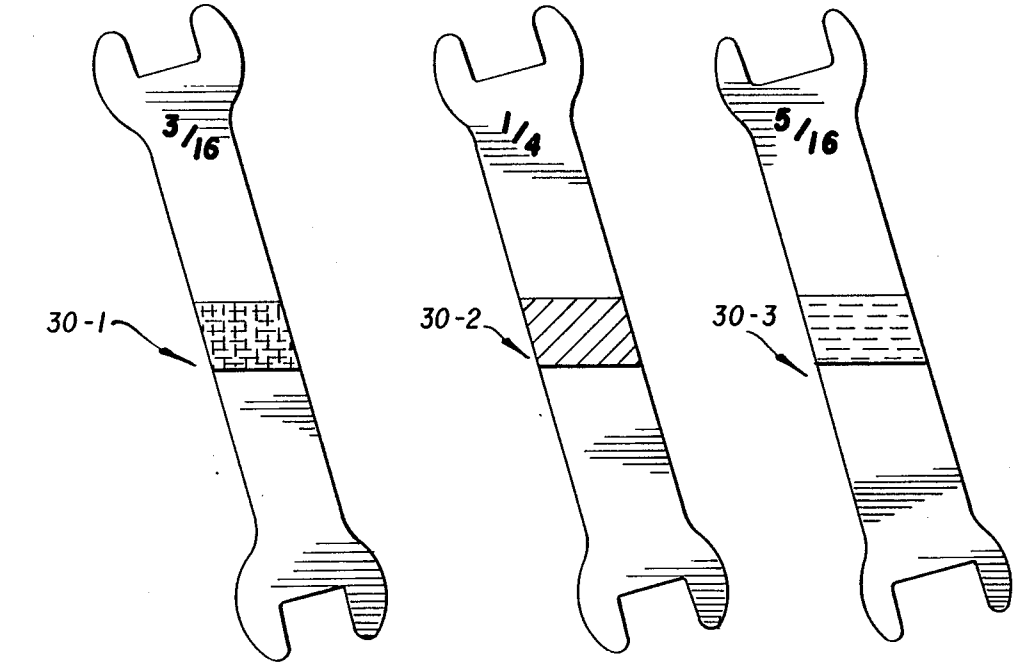
FIG. 3 is a further modification of the prior art in accordance with the invention showing an alternative set of nonalphanumeric markings.

FIG. 3 shows English measure counterparts for the wrenches in FIG. 2. The three wrenches 30-1, 30-2 and 30-3 have respective openings of of 3/16, ¼ and 5/16. Accordingly, using the color code previously discussed, each wrench bears color bands with stripes. The band color indicates the fractional opening size. Accordingly, wrench 30-1 has a yellow band corresponding to 3/16. Wrench 30-2 has a tan band corresponding to ¼ and wrench 30-3 has a gray band corresponding 5/15 inches.

An alternative set of markings for the wrenches of FIG. 3 can employ four code bands for each piece. Thus, wrenches 30-1, 30-2 and 30-3, with respective openings of 3/16, ¼ and 5/16 can employ two bands to indicate the numerator of the fractional opening size and two additional bands to indicate the denominator. The presence of four bands would distinguish the wrenchs of FIG. 3 as being in accordance with English measure, by contrast with two-banded metric measure. Using this arrangement wrench 30-1 would have successive black, orange, brown and blue bands corresponding to 03/16 or 3/16. Wrench 30-2 would have successive black, brown, black and yellow bands corresponding to 01/04 or ¼. Wrench 30-3 would have successive black, green, brown and blue bands corresponding to 05/16 or 5/16.

What is claimed is:

1. The method of selecting a tool having a particular size designation from among a plurality of tools of different sizes comprising the steps of (1) color coding the tools so that each tool has a plurality of bands wherein the color of each band represents a particular digit in the size designation of each tool; and (2) selecting from the plurality of tools, the tool bearing a plurality of bands having colors corresponding to the digits of the desired particular size designation.

2. The method of claim 1 wherein two bands are provided for each tool with each band representing a digit in a metric size designation.

3. The method of claim 1 wherein four bands are provided for each tool with two bands representing successive digits in a numerator of a fractional size designation and the remaining two bands representing successive digits in the denominator in the fractional size designation.

4. The method of claim 1 wherein said plurality of bands are provided on a set of wrenches and each band represents a digit in the size designation of the wrench.

5. The method of claim 1 wherein the color bands are striped in order to associate the color bands with tools of a specified system of measure.

6. The method of claim 1 wherein the color bands are of a solid color in order to associate the color bands with tools of a specified system of measure.

* * * * *